United States Patent [19]

Chatard et al.

[11] 4,343,370

[45] Aug. 10, 1982

[54] TURBO-CORING DEVICE EQUIPPED WITH A FOLLOWING PIPE

[75] Inventors: Michel Chatard; Alain Sonnet, both of Rueil Malmaison; Jean Thiery, Le Pecq, allof, France

[73] Assignee: Commissariat a l'Energie Atomique, Paris, France

[21] Appl. No.: 158,265

[22] Filed: Jun. 10, 1980

[30] Foreign Application Priority Data

Jun. 13, 1979 [FR] France ..... 79 15334

[51] Int. Cl.[3] ..... E21B 4/02

[52] U.S. Cl. ..... 175/107; 166/240; 166/319; 175/321

[58] Field of Search ..... 175/107, 26, 321; 166/240, 319

[56] References Cited

U.S. PATENT DOCUMENTS

| | | | |
|---|---|---|---|
| 2,879,032 | 3/1959 | Whittle | 175/26 |
| 2,915,285 | 12/1959 | Deily | 175/107 |
| 2,944,795 | 7/1960 | LeBus, Sr. | 175/381 |
| 3,661,218 | 5/1972 | Brown | 175/107 |
| 3,802,515 | 4/1974 | Flamand et al. | 175/76 |
| 4,019,592 | 4/1977 | Fox | 175/234 |
| 4,275,795 | 6/1981 | Beimgraben et al. | 175/107 |

FOREIGN PATENT DOCUMENTS

| | | | |
|---|---|---|---|
| 1163276 | 4/1958 | France | 175/107 |
| 1179172 | 7/1959 | France | 175/107 |

*Primary Examiner*—James A. Leppink

*Attorney, Agent, or Firm*—Pearne, Gordon, Sessions, McCoy & Granger

[57] ABSTRACT

This turbo-coring device comprises a tubular body provided with a coring bit and surrounded by a following pipe provided by a reaming bit. The tubular body is connected to the turbine through a fluid distributor having a side opening for discharging above the following pipe in the annular space between the device and the borehole wall a fraction of the fluid leaving the turbine, while the remaining fraction feeds the tubular body.

The following pipe is connected to the outer wall of the fluid distributor through releasable bayonet type latching means.

Means are provided for automatically closing the fluid discharge opening when the lower part of the tubular body becomes obturated by ground formations and an annular sealing packer is positioned between the tubular body and the following pipe.

4 Claims, 10 Drawing Figures

TURBO-CORING DEVICE EQUIPPED WITH A FOLLOWING PIPE

The present invention relates to a turbine-driven coring device or turbo-corer provided with a following pipe or casing.

This coring device comprises a tubular body provided with a coring bit, said tubular body being connected to a turbine through means for distributing the flow of hydraulic fluid leaving the turbine, and being surrounded by a following pipe, also called follower, coaxial to this tubular body.

This coring device enables geological samples to be collected in unstable, or loose, grounds, since the following pipe covers the wall of the drilled wellbore as the coring device is driven into the ground, thereby preventing collapsing of this wall, which would result in the fall of ground cuttings onto the hole bottom and thus interfere with subsequent coring operation.

One of the problems to be solved when building such a device results from the use of a drilling turbine for rotating the corer.

A drilling turbine is driven at a high rotation speed which is well adapted to the actuation of a coring bit, but this turbine requires too high fluid flow rates to enable ground samples to be collected under proper conditions.

This problem may be solved by positioning beneath the turbine a device for by-passing a large fraction of the flow which has passed through the turbine, this fraction being discharged through at least one radial nozzle opening above the following pipe, so that the discharged fluid flows upwardly towards the ground surface through the annular space between the borehole wall and the tubular column which houses the core holder.

However it may be difficult, which such a turbo-corer, to detect a possible obturation of the core-holder, such as for example by loose grounds.

As a matter of fact, the overpressure resulting from such an obturation of the lower part of the device has no substantial effect at the ground surface, since a large fraction of the fluid is diverted towards the above-defined annular space, just beneath the turbine. This drawback can be obviated in a device according to the invention by using distribution means for the hydraulic fluid comprising a cylinder having at least one lateral opening and a tubular piston slidable in said cylinder, this piston having a longitudinal bore wherein is located an axial nozzle, said piston having at least one lateral opening which can register with said lateral opening of the cylinder, a radial nozzle being located in one of said lateral openings of said cylinder and piston, this distribution means having resilient means urging said piston to a first position, wherein said lateral opening of said piston is offset from said lateral opening of said cylinder, said resilient means being so calibrated that, for a predetermined sufficient flow rate of the hydraulic fluid the fluid pressure difference between the two sides of said axial nozzle displaces the piston to a second position, wherein said lateral opening of the piston registers with said lateral opening of the cylinder.

A particular object of the invention is to provide a device whereby the tubular body of the corer can be made integral with its following tube or casing so as to collect a ground sample or core, while simultaneously advancing the following pipe, or alternatively to lift said tubular body housing the core-holder, while leaving in the bore said following pipe so that the core-holder can be withdrawn by a conventional wire line operation.

An embodiment of the invention whereby the above objects can be achieved is illustrated by the accompanying drawings, wherein:

FIG. 1 diagrammatically illustrates a coring device according to the invention,

Figure 1:
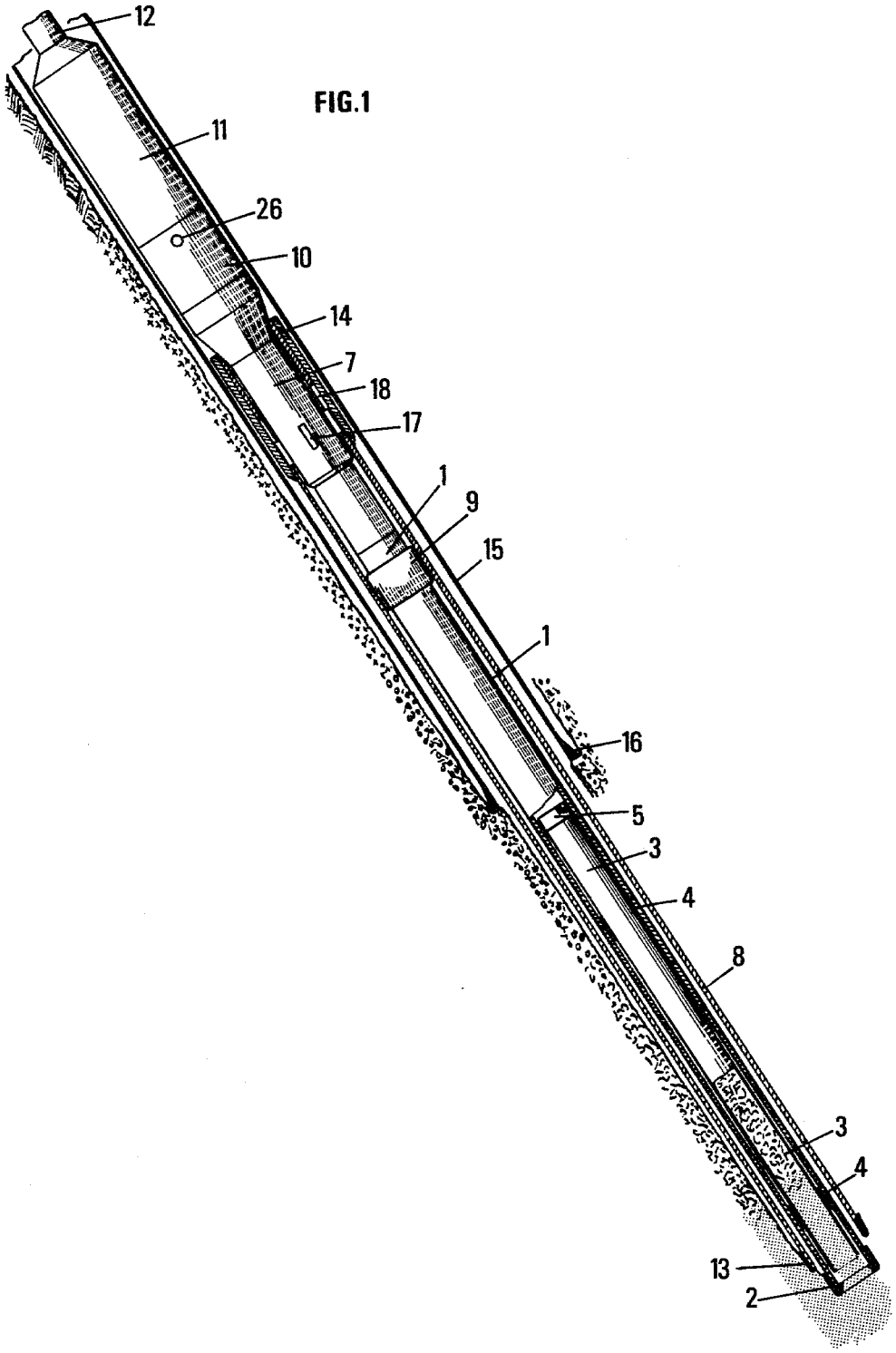

Throughout the drawings illustrating an embodiment of the coring device according to the invention, reference numeral 1 designates the tubular body of the coring device having at its lower part a coring bit 2.

A core-holder 3 is housed in the tubular body 1 at the lower part of the latter, above the coring bit 2. This core-holder comprises, as usual, latching means 4 whereby it can be locked within the tubular body 1, these latching means being releasable by means of a fishing tool or overshot introduced through the upper orifice 5 of the core holder 3, this orifice being provided with holding splines.

The fishing tool can be lowered into the tubular body 1 suspended from a fishing cable. The tubular body 1 comprises at its upper part a latching connector 7 which can be locked at the top of a following pipe of casing 8. An inflatable packer 9, surrounding the tubular body 1, separates the space above the packer from the annular space between this tubular body and the following pipe 8.

The connector 7 is coupled, via a hydraulic distributor 10, to the rotor of a turbine 11 supplied with hydraulic fluid from the ground surface through a tubular column 12.

The distributor 10 for the hydraulic fluid leaving the turbine is located between the turbine 11 and the connector 7.

This distributor which will be described below in more detail comprises at least one radial nozzle for laterally discharging the major part of the fluid leaving the turbine, this discharged fraction flowing upwardly towards the surface through the annular space between the turbine 11 and the column 12. An axial nozzle communicates with the interior of the tubular body 1 through the connector 7.

The following pipe 8 (which may be formed of several elements connected end to end) comprises at its lower part a reaming bit 13 for reaming the drilled borehole. This casing is rotated with the tubular body 1 and advances in the borehole together with this tubular body, owing to the latching connector 7 which rests on the head 14 of the following pipe 8. The latching connector is of the bayonet type, enabling simultaneous lifting of the assembly formed by the tubular body 1 (housing the core barrel 3), the connector 7, the distributor 10 and the turbine 11, without raising the following pipe 8 which thus remains in place to support the walls of the surrounding unstable geological formations.

The reference numeral 15 designates an outer casing independent of the coring device this casing having an annular shoe 16 (these elements form no part of the invention).

Figure 2:
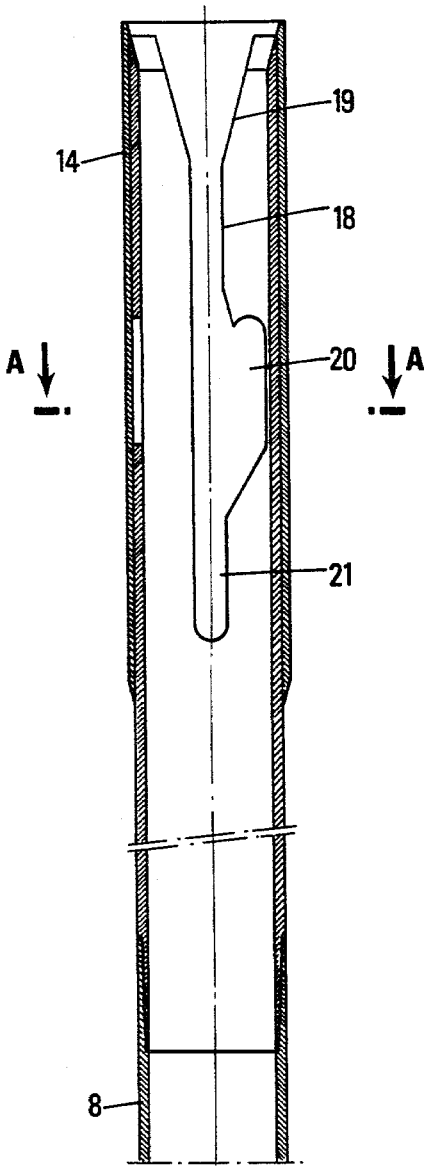
FIG. 2 is an axial cross-section of the upper part of the follower casing.
Figure 2A:
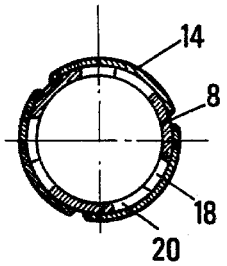
FIG. 2A is a cross-section by plane A—A of FIG. 2.
Figure 4:
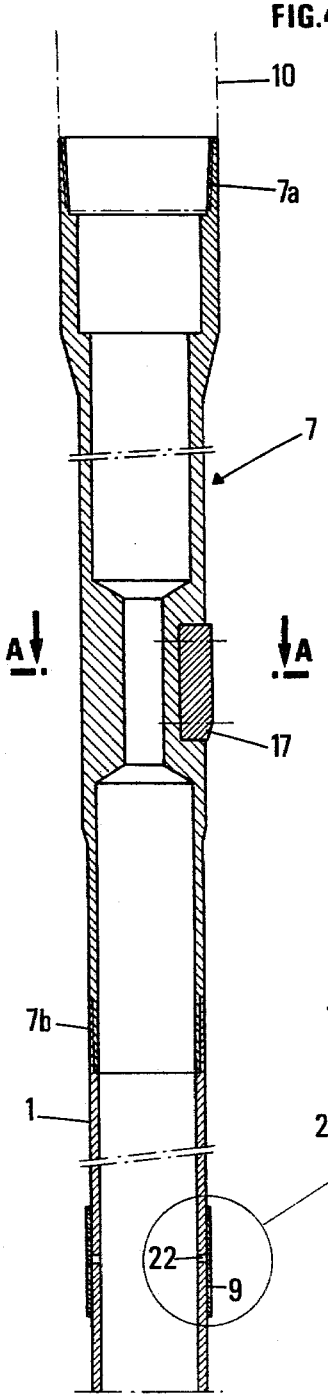
FIG. 4 is a longitudinal cross-section showing the latching connector and the inflatable packer.
Figure 4A:
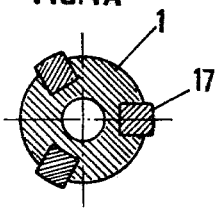
FIG. 4A is cross-section by plane A—A of FIG. 4.
Figure 4B:
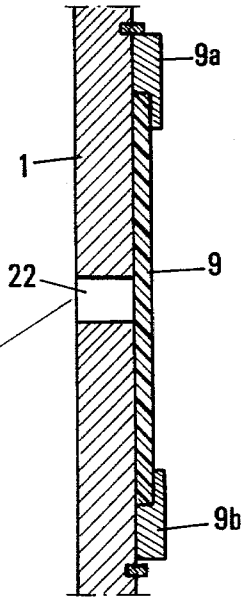
FIG. 4B is an enlarged detail view of FIG. 4 showing the sealing packer.

FIG. 2 illustrates an arrangement of the head 14 of the following pipe 8 permitting latching of the bayonet type with the connector 7 which is provided with pins 17 for this purpose (FIGS. 4 and 4A).

The head 14 comprises axial splines or slots 18 flaring outwardly at 19 at their top to facilitate insertion of the pins 17.

Figure 3:
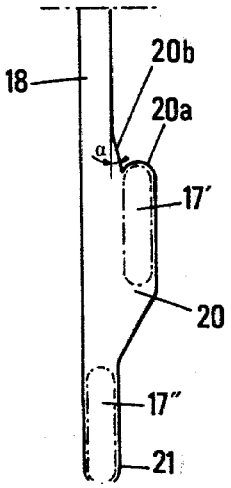
FIG. 3 illustrates clamping means on the follower-casing.

Lateral recesses 20 are adapted to receive the pins 17 so that the following pipe 8 and the tubular body 1 can be made fast with each other both in rotation and in translation (position 17' of the pins 17 in FIG. 3 where each pin 17 is located in its recess 20 in axial abutment against a wall 20*a* of this recess).

By an axial displacement and a rotation of the tubular assembly formed by the column 12, the turbine 11, the distributor 10 and the connector 7, it is then possible to release the latter, each pin 17 then coming to the position 17", shown in FIG. 3 where this pin is engaged in a lower recess 21.

From the latter position it is possible to lift said tubular assembly by a simple pull, leaving the following pipe 8 in its position in the borehole.

A slightly tapered shape (corresponding, for example, to a conicity $\alpha$ of about 10°) is given to the wall 20*b* connecting the slots 18 to the lateral recesses 20, to facilitate direct passage of the pins 17 from the recesses 21 into these slots 18 (since a slight deviation of the pins 17 relative to a vertical line cannot be avoided during the upward displacement of these pins).

FIG. 4 diagrammatically illustrates, an embodiment of the latching connector 7 in axial cross-section.

This connector mainly comprises a tubular element having at its periphery three pins 17 angularly spaced by 120° about the longitudinal axis of the connector 7. These pins 17 are adapted to engage the slots 18 and the recesses 20 and 21 of the head 14 of the casing 8, as above-indicated. The connector 7 can be screwed at 7*a* at its upper part on the hydraulic distributor 10 and at 7*b* at its lower part on the upper part of the tubular body 1.

FIG. 4 also illustrates the packer 9 constituted by a sleeve of elastomer surrounding the tubular body 1 to which this packer is secured at 9*a* and 9*b*. This packer is inflated by the action of the hydraulic pressure within the tubular body 1, this pressure being transmitted through openings 22 of the wall of the tubular body 1.

The so-inflated packer provides annular sealing between the columns 1 and 8, causing the fluid flow oriented by the axial nozzle 29 of the hydraulic fluid distributor 10 towards the bits 2 and 13, to wash and cool these bits and to flow towards the surface through the annular space delimited between the casing 8 and the borehole, thus driving along the cuttings from the ground formation resulting from the cutting action of the bits 2 and 13. In the absence of this packer, the flow from the nozzle 29 could rise in the annular space between the columns 1 and 8, without irrigating the bit 13, which would result in bad working conditions of this bit.

Figure 5A:
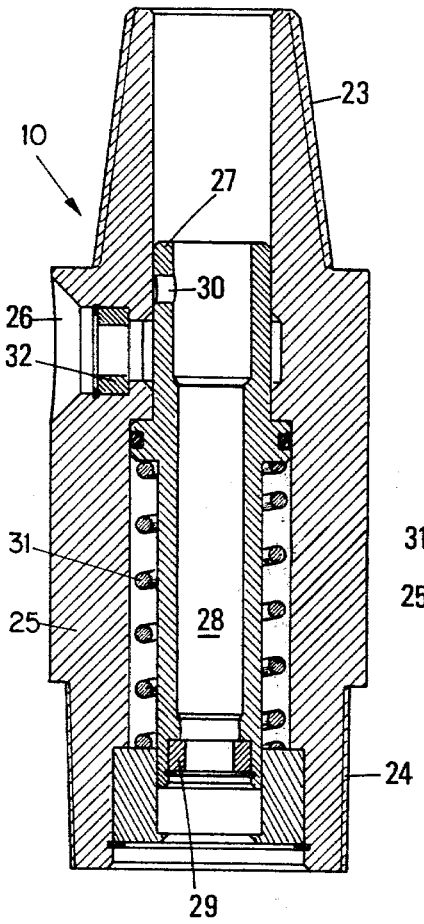
FIGS. 5A and 5B show in axial cross-section the two positions of the hydraulic fluid distributor.

FIG. 5A is a longitudinal cross-sectional view of the hydraulic fluid distributor 10 which is connected by the threadings 23 and 24 to the turbine 11 and the connector 7 respectively.

This distributor 10 comprises a cylinder 25 having at least one lateral opening 26 and a tubular piston or sleeve 27 slidably mounted in the cylinder 25. The piston 27 comprises a longitudinal bore 28 housing an axial nozzle 29, a lateral opening 30 which can register with the lateral opening 26 of the cylinder 25 upon downward displacement of the piston 27 from its position in FIG. 5A to its position shown in FIG. 5B, against the action of a return spring 31.

Figure 5B:
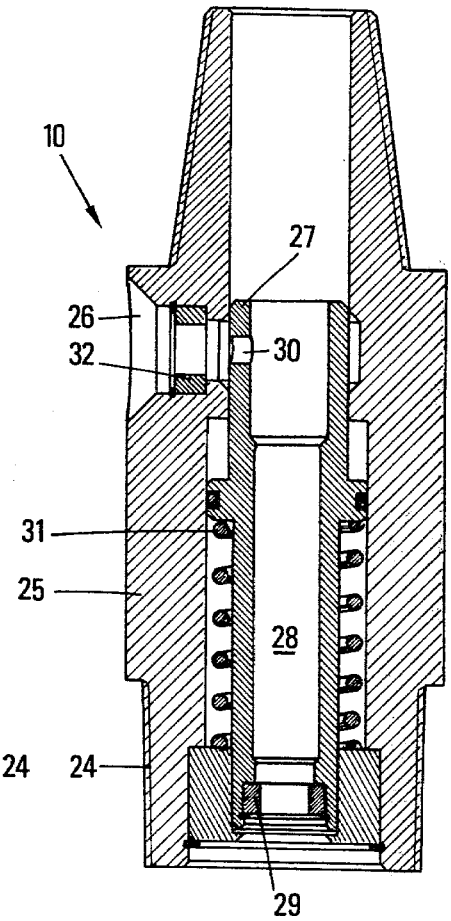

A radial nozzle 32 is housed in one of the openings 26 or 30 (in the opening 26 in the embodiment shown in FIGS. 5A and 5B).

The position shown in FIG. 5A is the stable rest position of the piston. When the operation is started the whole fluid flow rate feeding the turbine thus flows through the axial nozzle 29, developing a fluid pressure which strongly compresses the spring 31.

The piston 27 is then displaced to its position in FIG. 5B where the openings 26 and 30 register with each other. Under these conditions a substantial fraction of the flow rate leaving the turbine is diverted in a radial direction and rises towards the ground surface, flowing through the radial nozzles 32 into the annular space delimited by the tubular column 12 and the casing 15.

The remaining fluid flows through the axial nozzle 29 and the connector 7 towards the tubular body 1, its flow rate (which is fixed by the ratio of the cross-sections of nozzles 29 and 32) being sufficient to achieve washing and cooling of bits 2 and 13, but is not too high, so as to prevent erosion of the lower part of the core, specially in loose ground formations.

The spring 31 is so calibrated that for this value of the flow rate through the axial nozzle 29, during a coring operation under normal conditions, the pressure difference applied to the piston 27 maintains the same in the position shown in FIG. 5B.

If the lower part of the core holder becomes obturated, the resulting interruption of the fluid flow through the axial nozzle 29 causes an upward displacement of the piston 27 to its position shown in FIG. 5A. Fluid by-passing through the lateral orifices 30 and 26 is then interrupted whereby the whole flow rate is again oriented towards the core holder and may be sufficient to clear this core holder, or if this does not occur, a sudden pressure drop will be transmitted to the ground surface where the abnormal operation of the corer will thus be detected.

The coring device is then raised to the surface if clearance thereof in the borehole does not occur.

OPERATION

When the different elements of the device are assembled as shown in FIG. 1, the pins 17 of the connector 7 are positioned in the recesses 20 and are in axial abutment at 20*a* (FIG. 3). Starting the operation of the turbine 11 automatically causes rotation of the assembly formed by the distributor 10, the latching connector 7 and the tubular body 1, as well as rotation of the following pipe 8, owing to the bayonet connection.

Application of a fraction of the overall weight of the turbine 11 and of the column 12 to the tubular body 1, according to the conventional rotary drilling process, causes penetration of the bit 2 into the ground and initiates the building of a core. During this phase the reaming bit 13 also rotates on the hole bottom. However this bit is only loaded by the own weight of the casing 8 minus the friction of the latter on the borehole wall. Under such reduced load the penetration of the reaming bit 13 is slower than the penetration of the coring bit 2. Consequently the pins 17 are displaced downwardly into the recesses 20, moving from their position 17' to the position 17''. As soon as the pins 17 have reached this last position, a fraction of the weight applied to the tubular body 1 is applied to the casing 8, by means of the pins 17 bearing on the walls of the recesses 21, thus accelerating the penetration of the reaming bit 13. Under these conditions the bits 2 and 13 continue their simultaneous penetration by a self-regulated effect, maintaining their relative configuration shown in FIG. 1 (the bit 13 follows the bit 2), which ensures optimum working conditions of the coring bit 2 as regards building of the core.

Normal procedure for collecting the cores consists in lifting the core-holder 3 to the surface, while leaving the following pipe 8 in its position at the lower part of the borehole.

To this end the reversing of the direction of rotation of the turbine permits to release the pins 17 from their recesses 21, these pins following the slots 18 without entering the recesses 20.

As above indicated, a slight conicity $\alpha$ of the wall 20*b* connecting the recesses 20 to the slots 18 facilitates this operation.

When the upper section of the tubular body 1 has been raised to the surface and is secured to the derrick floor, the connector 7 is unscrewed from this upper section and the collected core can then be extracted by withdrawing the core-holder 3 from the tubular body 1 by means of a wire line supporting a fishing tool which may be of conventional design.

The assembly of the tubular body 1 and of the following tube 8 may be occasionally raised to the surface so as to lengthen the following tube 8 whenever necessary as the operation progresses. This simultaneous lifting of the columns 1 and 8 is achieved by exerting a pull on the column 12 while maintaining the torque applied by the turbine. This combined action moves the pins 17 to their position 17'. The casing 8 is then driven along owing to the locking assembly 17'–20*a*.

A problem may arise in some cases when the connector 7 is to be locked, after the assembly 1–3–7–10–11 has been lowered back into the well and the tubular body 1 has been inserted into the following pipe 8.

As a matter of fact, sediments may have crumbled down or rised in the following pipe 8 while the tubular body 1 was lifted to the surface and it may happen that the tubular body 1 cannot any more be sufficiently lowered into the following pipe 8 to position the pins 17 in the recesses 20 and thus ensure simultaneous operation of the bits 2 and 13 as above described.

This drawback is avoided in the preferred embodiment of the invention which comprises auxiliary latching means for making the connector 7 and the head of the following pipe 8 fast in rotation with each other, these auxiliary means being located above the level of the recesses 20 of FIG. 2.

Figure 6:
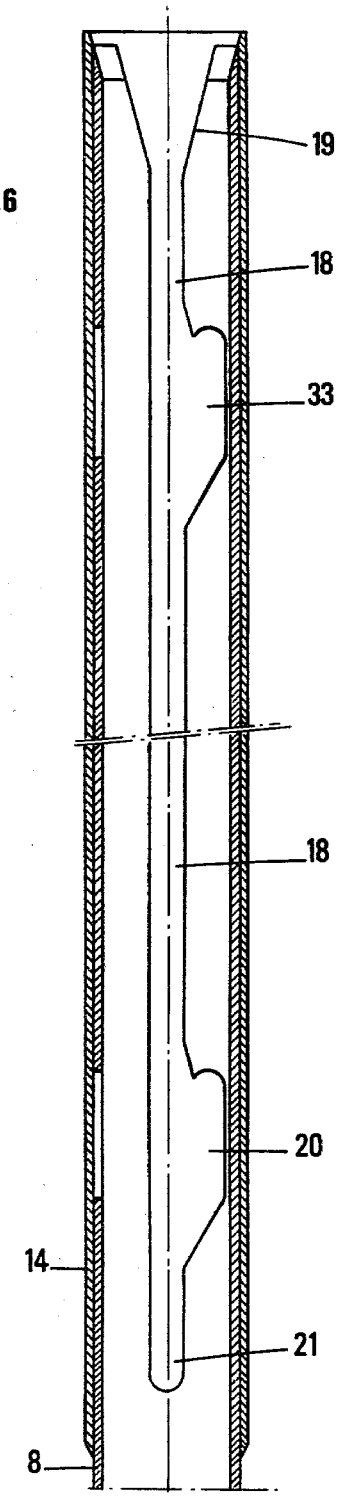
FIG. 6 illustrates a preferred embodiment of the latching means.

As illustrated in FIG. 6, such auxiliary means may be formed by a second bayonet coupling located above the main coupling and comprising recesses 33 located above the recesses 20, these recesses 33 enabling the connector 7 and the following pipe 8 to be made fast in rotation with each other, even when the tubular body cannot be lowered back to its position shown in FIG. 1.

By rotating the follower-casing 8 and lifting it from the hole bottom it is then possible to remove the sediments from the lower part of the casing.

The auxiliary bayonet assembly may then be unlocked and the core-holder lowered down to its normal working position where the pins 17 of the connector 7 are inserted in the recesses 20.

What is claimed is:

1. A coring device comprising a tubular body provided with a coring bit, said tubular body being housed in a following pipe which is provided with a reaming bit and being connected to a turbine through at least one hydraulic fluid distributor adapted to discharge through at least one lateral opening a fraction of the fluid flow leaving the turbine, while the remaining fraction of this fluid flow feeds said tubular body, releasable latching means permitting to connect said tubular body and said following pipe, wherein said fluid distributor is provided with means for automatic interruption of the fluid discharge through said lateral opening, when the lower part of said tubular body is obturated by ground formations, and wherein said releasable latching means are of the bayonet type and maintains said lateral opening of said fluid distributor at such a level as to discharge the fluid above said following pipe, this coring device further comprising, in combination with said fluid distributor, an annular sealing packer located between said tubular body and said following pipe, so that at the bottom of the device the fluid leaving said tubular body flows upwardly from said coring bit to said reaming bit.

2. A coring device according to claim 1, wherein said annular sealing packer is inflatable under the action of the hydraulic pressure within said tubular body.

3. A coring device according to claim 1, wherein said bayonet type latching means comprises means distributed over two levels at the upper part of the following pipe, a first of said levels permitting locking of said tubular body in its normal working position within said following pipe, and the second of said levels, located above said first level, enabling said following pipe to be made fast in rotation with said tubular body when ground cuttings prevent the latter from sufficiently penetrating into the following pipe to reach its normal working position.

4. A device according to claim 1, wherein said hydraulic fluid distributor comprises a cylinder having at least one lateral opening and at least one tubular piston slidable in said cylinder, this piston having a longitudinal bore wherein is located an axial nozzle and having at least one lateral opening which registers with said lateral opening of the cylinder, a radial nozzle being located in one of said lateral openings of the cylinder and of the piston, said fluid distributor comprising resilient means urging said piston into a first position where the lateral opening of the piston is spaced apart from the lateral opening of the cylinder, and said resilient means being so calibrated that for a sufficient flow rate of the hydraulic fluid, the fluid pressure difference between the two sides of said axial nozzle, moves said piston towards a second position wherein said lateral opening of the piston registers with the lateral opening of said cylinder.

* * * * *